US006906254B2

(12) United States Patent
Reed

(10) Patent No.: US 6,906,254 B2
(45) Date of Patent: Jun. 14, 2005

(54) SOLAR-POWERED MOBILE

(76) Inventor: John Reed, 245 E. 93rd St., Suite 17J, New York, NY (US) 10128

( * ) Notice: Subject to any disclaimer, the term of this patent is extended or adjusted under 35 U.S.C. 154(b) by 503 days.

(21) Appl. No.: 10/226,817

(22) Filed: Aug. 23, 2002

(65) Prior Publication Data

US 2004/0035459 A1 Feb. 26, 2004

(51) Int. Cl.[7] ..... H01L 31/00; H01L 31/042; G09F 19/02; A63H 33/00; A63H 13/20

(52) U.S. Cl. ..... 136/291; 446/227; 446/236; 472/1; 472/10

(58) Field of Search ..... 136/291; 446/30–33, 446/36–45, 227, 236, 396; 472/6–12, 1

(56) References Cited

U.S. PATENT DOCUMENTS 1,593,720 A * 7/1926 William ..... 40/411
1,722,922 A * 7/1929 Johnson ..... 472/10
2,074,878 A * 3/1937 Wilhelm ..... 472/10
3,546,811 A * 12/1970 Kupperman et al. ..... 446/33
5,518,205 A * 5/1996 Wurst et al. ..... 244/58

FOREIGN PATENT DOCUMENTS

CH 687360 * 11/1996 ..... A47G/35/00
JP 01-114885 * 8/1989 ..... G09F/19/02

* cited by examiner

*Primary Examiner*—Nam Nguyen
*Assistant Examiner*—Jeffrey Barton
(74) *Attorney, Agent, or Firm*—Notaro & Michalos, P.C.

(57) ABSTRACT

A mobile has mobile elements made from a solar cell, a hollow beam and a motivator. The solar cell is mounted to a substrate and connected via wires through the hollow beam to the motivator. The hollow beam supports the substrate at one end and the motivator at the other. The motivator may be a small electric fan or valved gas jet. The substrate is a flat plastic panel, such as a CD-ROM disc, a lightweight plastic sheet, and printed circuit board. The mobile elements may be connected as in a traditional Calder mobile, or in an aligned vertical stack. As the solar panels receive sufficient light, power for the motivator is generated, causing the mobile elements to move.

25 Claims, 6 Drawing Sheets

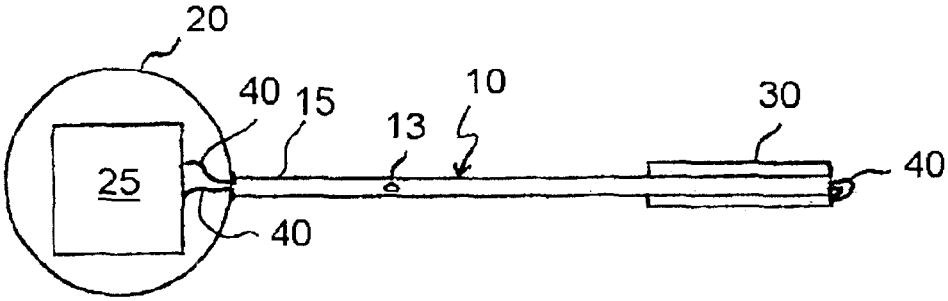
FIG. 1
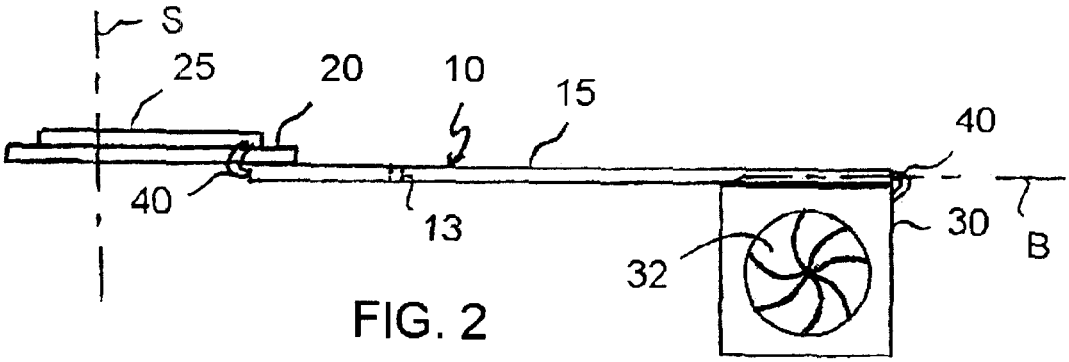
FIG. 2
FIG. 3A
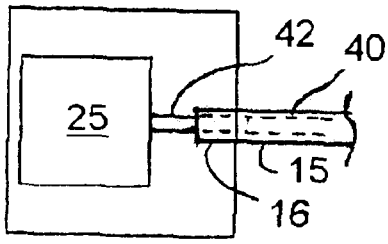

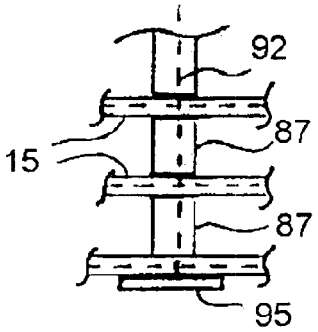
FIG. 10
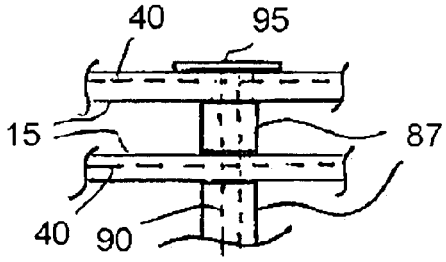
FIG. 8
FIG. 11
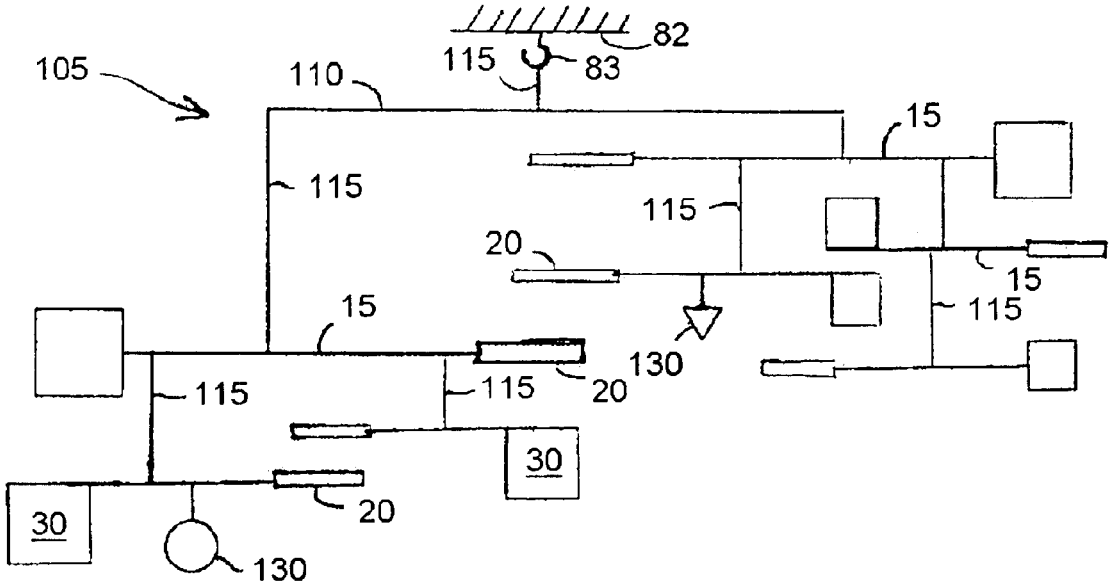

SOLAR-POWERED MOBILE

FIELD AND BACKGROUND OF THE INVENTION

The present invention relates generally to the field of mobiles, such as first developed by Alexander Calder, and in particular to a new and useful solar-powered, motivated mobile for providing an entertaining display to amuse viewers.

The artist Alexander Calder is perhaps best known as the inventor of displays of beams and depending objects, balanced with each other and connected to move freely in air currents, commonly called mobiles. The mobiles created by Calder generally comprise a main horizontal beam suspended from a ceiling or other elevated support, which main beam in turn supports several depending horizontal beams and connected ornamental objects in a balanced arrangement. The point of connection between beams, length of the beams and the position and weight of the individual objects forming the mobile are all factors that can be used to balance the mobile. Most Calder mobiles utilize wire strands to connect the beams and objects.

Calder and others who have built mobiles design their mobiles to move in response to air currents surrounding the mobiles, or sometimes, pulling and pushing of the mobile elements by children. That is, the mobiles are not self-motivating, and rely on external forces acting on the mobile elements to cause movement.

Mobiles are a popular ornamental entertainment device, as the pattern of movement by the elements making up the mobile is unlikely to repeat exactly within a noticeable period. Similar to fish tanks, people enjoy looking at mobiles for relaxation or amusement.

Mobiles are often provided near babies cribs because they usually incorporate elements with a variety of different shapes and colors. In combination with the ability to move inherent in mobiles, these features make them useful tools for amusing and stimulating the minds of babies. Traditional Calder mobiles may be hung near a crib, out of reach of the baby, so that it is only seen and cannot be touched. In such cases, the mobile is not likely to move when the air in the room is still.

A motionless mobile is clearly less entertaining than a moving mobile. But, it may not be possible or advisable to create a draft in the room of a baby or child. Thus, mobiles have been developed with motors to cause the mobile elements to move. These mobiles generally have a different structure from traditional Calder mobiles resulting from the difficulty of connecting a motor to each traditional mobile element unless they are centrally attached. Thus, motorized mobiles usually have one or more beams supporting an ornamental object at one end and connected at their other end to a single, center axle which is driven by a motor.

Many patents disclose mobiles of this type. U.S. Pat. No. 6,113,455, for example, teaches a mobile having a vertically oriented central motor and axle with several horizontally extending arms connected between the axle and a decorative shape supported at the far end. The mobile is designed to be mounted on a crib over the head of an infant, so that the decorative shapes are rotated around the axle.

U.S. Pat. No. 6,068,535 discloses a motorized mobile with a central motor and axle and several detachable elements. When some mobile elements are detached, the remaining elements can be balanced by sliding balancing weights along the support arms to offset the weight of the missing element.

U.S. Pat. No. 5,951,360 to Fearon et al. teaches a motorized mobile having a CD player as part of the mobile. The mobile elements are turned in synchronization to the music played.

As can be understood, these types of mobiles are less traditional in that the several beams are not connected to each other, but to a center axle. These mobiles do not balance or move in alternating patterns the same way as a traditional Calder mobile.

Since the time Calder invented the mobile, he and others have balanced a variety of stationary objects to create ornamental designs. A particularly interesting mobile of traditional construction having interconnected elements that each include a light source is taught by U.S. Pat. No. 5,791,775. The elements are connected to each other to balance the weight of the light sources mounted in each. The light sources are oriented facing upwardly, so that as the mobile elements rotate relative to each other, different light patterns are produced by the light sources. A conductive wire carries power to each light source. The wire runs through connecting posts between mobile elements and within the mobile elements. In one embodiment, disc-shaped fins for catching air are connected to each element to cause the mobile elements to spin. The fins may be connected to the portion of the element carrying the light source by a hollow tube.

Toys having a center support for a beam, and a simulative flying machine at one end of the beam are also known. Many of these toys are intended to simulate airplanes, such as described in U.S. Pat. No. 1,827,775. The patent teaches a toy airplane mounted on a rotating, counter-balanced arm connected to a support post. The airplane has a propeller driven by a wound spring. When the propeller and spring are released, the airplane begins to rotate the arm about the support post, and the airplane rises into the air as the counter-balance weight on the arm becomes equal to the weight of the moving airplane. The counter-balance weight can be a simulative dirigible or airplane.

It should be noted that in toys of this type, unless the simulative flying machine is active, the supporting arm is not balanced about the center support post. Rather, the end of the arm with the simulative object is permitted to fall to the ground, much like a see-saw with only one rider.

But, mobiles having a self-contained power source and individually motivated beams are not known. Traditional Calder mobiles and other with balanced beams supporting objects especially are not known to have any self-motivating capability.

SUMMARY OF THE INVENTION

It is an object of the present invention to provide self-motivating elements for balancing in a mobile.

Yet another object of the invention is to provide a mobile having elements capable of producing their own movement, unassisted by external forces.

It is a further object of the invention to provide a mobile with self-motivating elements that can interact to change the movement.

A still further object of the invention is to provide a light-activated mobile for producing entertaining patterns.

Another object of the invention is to create a mobile using discarded computer-related components.

Accordingly, mobile elements made from a solar cell, a hollow beam and a motivator electrically connected to the solar cell are provided. The solar cell is mounted to a substrate and connected via wires through the hollow beam to the motivator. The hollow beam supports the substrate at one end and the motivator at the other. The motivator may be a small electric fan or valved gas jet. The substrate is a lightweight panel, such as flat plastic panel, a CD-ROM disc, a section of printed circuit board or a sheet of lightweight plastic. The motivator and substrate with the solar cell are sized so that a balance point, or center of gravity, exists at some point on the hollow beam between them.

The mobile elements can be arranged to construct mobiles of varying types. A traditional mobile is provided in which a primary beam supports several of the inventive mobile elements in a balanced configuration. Objects other than the substrates with solar cells and motivators can be balanced on some of the mobile element beams.

An alternative mobile configuration has several vertically spaced mobile elements of different lengths arranged with the substrates aligned in a column, one over the other. The mobile elements are mounted to a support and balanced relative to the support so the beams extend horizontal in the absence of any external forces other than gravity. As light strikes each solar cell in turn, power is generated for activating the motivator. The active motivator causes the mobile element to rotate about the axis where the element beam is connected to its support.

A mobile of the invention provides environmental benefits as well when the substrates are unused or defective CD-ROM discs and the motivators are old computer CPU cooling fans. The wires used to connect the fans to the solar cells can also be scavenged from old computers. The mobile elements can be made in large part from recycled components having little value otherwise.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a top plan view of a mobile element of the invention;

FIG. 2 is a side elevation view of the mobile element of FIG. 1;

FIG. 3A is a top plan view of an alternative power generation end of the mobile element of FIG. 1;

FIG. 8 is a detail view of the support column of the mobile of FIG. 7;

FIG. 10 is a detail view of the support column of the mobile of FIG. 9; and FIG. 11 is side elevation view of an alternate hanging mobile according to the invention.

DESCRIPTION OF THE PREFERRED EMBODIMENTS

Figure 3B:
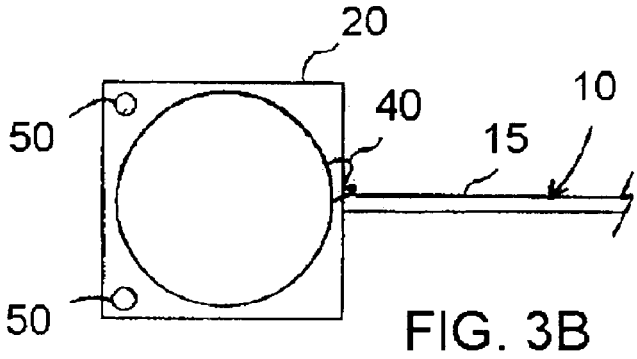
FIG. 3B is a top plan view of a second alternative power generation end of the mobile element of FIG. 1.

Referring now to the drawings, in which like reference numerals are used to refer to the same or similar elements, FIGS. 1 and 2 show a mobile element 10 having a hollow support beam 15 connecting a substrate 20 and a motivator 30. Beam 15 includes a mounting hole 13 for connecting the mobile element 10 to other components. The substrate 20 carries a solar cell panel 25. The solar cell panel 25 is electrically connected to motivator 30 via a pair of wires 40. Wires 40 extend through the hollow beam 15.

As will be understood, electrical power is generated by solar cell panel 25, and the power is transmitted via wires 40 to the motivator 30. The motivator 30 then converts the electrical power to a mechanical motivating force, as further described below.

The substrate 20 can be connected to the hollow beam 15 is any known manner. For example, one of the substrate surfaces can be glued to the beam 15. Or, if the beam 15 has a larger diameter than the thickness of the substrate 20, a groove could be formed in the end of the beam 15 to receive the edge of the substrate 20, such as best shown in FIGS. 3A, 6.

As seen in FIGS. 1 and 2, the substrate 20 is preferably a circular panel, such as a CD-ROM disc or a lightweight sheet of plastic such as COROPLAST from Coroplast, Inc. The substrate should be sufficiently self-supporting and rigid so as to remain horizontally planar when solar cell panel 25 is attached. Other preferred materials for the substrate 20 include printed circuit board (PCB), and old credit cards or other plastic sheets. If the substrate 20 and other materials are made weather-proof, a mobile incorporating the elements 10 can be used outdoors.

FIGS. 3A–3D illustrate different shapes of substrates 20 that can alternately be used with the mobile element 10 at the power generation end of the hollow beam 15.

The substrate 20 can be square, triangular or another polygonal shape. The substrate 20 is preferably the same size as the solar cell panel 25 for support. When the substrate 20 is larger than the solar cell panel 25, space is available for mounting weights 50 used to balance the mobile element 10 at a preferred position along beam 15. Weights 50 may be glued or otherwise secured to the substrate 20 in different locations to affect the location of the center of gravity of the mobile element 10 along beam 15. And, when the substrate 20 is the same size as cell panel 25, the weights could be secured to the bottom of the substrate 20. As should be understood, the center of gravity of the mobile element 10 is the point where the element 10 has equal weight on each side, so that it can balance about that point. Weights 50 are used to adjust the location of that point, which is preferably along the beam 15, as desired.

In FIG. 3A, if the substrate 20 is suitable for the purpose, such as when it is a PCB, electrical leads 42 may be etched onto the substrate 20. The portion 16 of beam 15 forming a groove for holding the substrate covers the terminal ends of the leads 42. Wires 40 may connect to leads 42 in any known manner. This configuration provides a very neat external appearance to the mobile element 10.

The substrate 20 may be the same size and shape as the solar cell panel 25 as well.

Figure 3D:
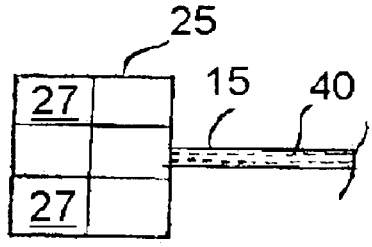
FIG. 3D is a top plan view of a fourth alternative power generation end of the mobile element of FIG. 1.
Figure 3C:
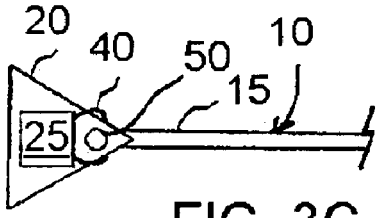
FIG. 3C is a top plan view of a third alternative power generation end of the mobile element of FIG. 1.

If a sufficiently rigid solar cell panel 25 is available, the substrate 20 may be made smaller, or eliminated, such as shown by FIG. 3D. FIG. 3D illustrates a solar cell panel 25 having several solar cells 27 joined together. The solar cell panel 25 preferably produces about 6 volts of electrical energy in total. Each solar cell 27 is preferably of a type which generates about 0.5 volts, so that 12 such cells combined in series will generate 6 volts. The amps generated by the cells 27 will be dependent on the rating of the smallest cell, and so they are preferably sized identically to simplify the electrical circuit and ensure sufficient power is provided to motivator 30. In full sunlight, the cells 27 can generate between about 200–350 mA.

Referring again to FIGS. 1 and 2, the motivator 30 connected to the other end of hollow beam 15 is preferably a small electric fan, such as a computer CPU cooling fan. The fan is preferably selected so that it will operate when powered with 6 volts.

The motivator 30 shown in FIG. 2, for example, has fan blades 32 arranged to accelerate air from one side of the fan to the other. Other motivators 30 envisioned for use include an electrically-valved pressurized gas source.

The motivator 30 can be connected to the hollow beam 15 by hanging it from the bottom edge of the beam 15. The motivator 30 can be secured by gluing, fusing, bonding or other methods which will rigidly connect the beam 15 and motivator 30. The motivator 30 is preferably oriented to direct a motivating force perpendicular to both the longitudinal axis B of the beam and a vertical axis S through the solar cell panel 25 and substrate 20. However, the motivator 30 could be oriented at angles which are oblique to each of the two referenced beam and substrate axes B, S. The majority of the force produced by the motivator 30 is preferably directed perpendicular to each of the beam and substrate axes B, S.

Figure 4A:
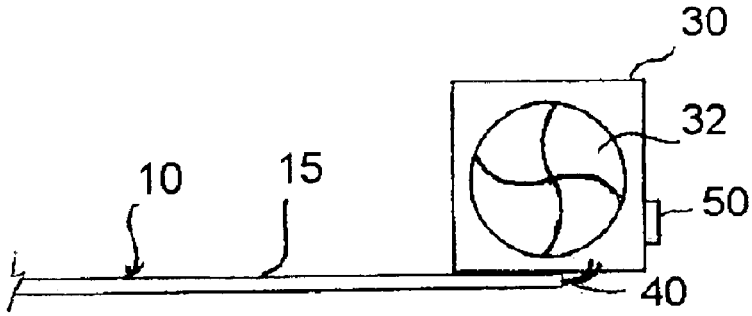
FIG. 4A is a side elevation view showing an alternate mounting position for the motivator of FIG. 1.
Figure 4B:
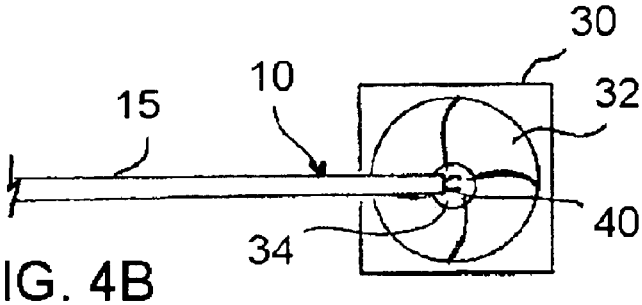
FIG. 4B is a side elevation view of a second alternative mounting position of the motivator of FIG. 1.

As shown in FIGS. 4A and 4B, the motivator 30 can be mounted to the beam 15 in other positions besides hanging from below. FIG. 4A illustrates supporting the motivator 30 on the top surface of the beam 15, while FIG. 4B shows how the beam 15 could extend along the front or back of the motivator 30 to hold it in place.

FIG. 4A shows a balancing weight 50 secured to the motivator 30 to modify the location of the mobile element 10 center of gravity. Weight 50 can be positioned elsewhere on the motivator and have a mass as needed to locate the center of gravity in a specific position on the beam 15.

FIG. 4B further illustrates a CPU fan motivator 30 having a motor 34 connected to wires 40 for receiving electrical power to drive the fan blades 32.

Wires 40 may extend loose through beam 15 between the motivator 30 and solar cell panel 25. However, the loose wires 40 may interfere with connecting the mobile element 10 with other elements.

Figure 5A:
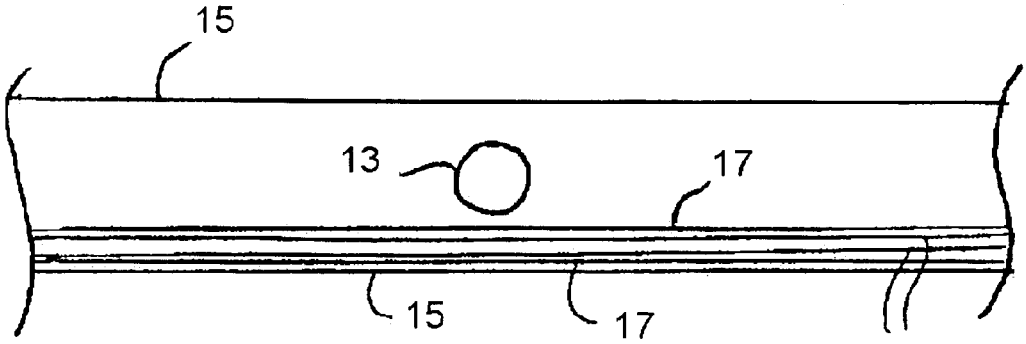
FIG. 5A is a sectional top plan view of an alternate hollow beam of the mobile element of FIG. 1.
Figure 5B:
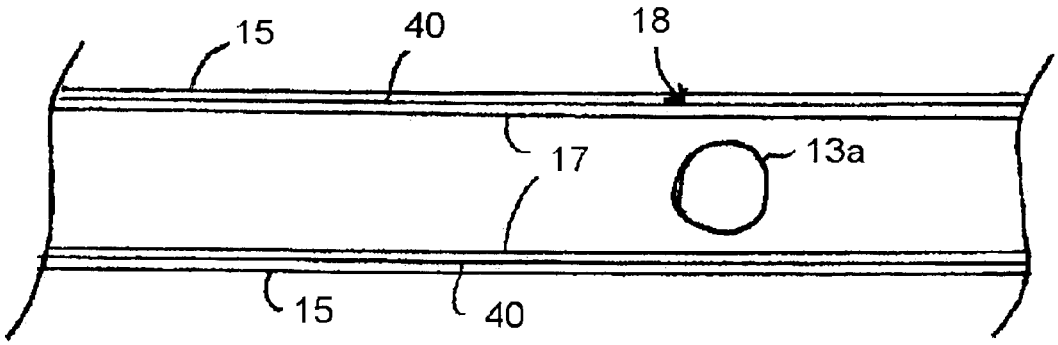
FIG. 5B is a sectional top plan view of a second alternate hollow beam of the mobile element of FIG. 1.

FIGS. 5A and 5B show two alternative configurations of the hollow beam 15 for containing wires 40. In FIG. 5A, a smaller diameter sheath 17 surrounds wires 40 along the interior side of the hollow beam 15. Mounting hole 13 in the bottom of the hollow beam 15 is shown as well. The sheath 17 is preferably rigid, but may be flexible so long as it retains the wires 40 away from the mounting hole 13. The mounting hole 13 should be kept unobstructed for freely attaching the mobile element 10 with other mobile components.

In FIG. 5B, a sheath 17 is provided having a diameter slightly smaller than the diameter of the hollow beam 15. Wires 40 pass through beam 15 in the annular space 18 between the outside of sheath 17 and the inside of beam 15. A second mounting hole 13*a* in sheath 17 is provided aligned with the mounting hole 13 of hollow beam 15 (not seen in FIG. 5B). In this arrangement, the wires 40 are held away from and do not interfere with any connecting element passing through the mounting holes 13, 13*a* in the beam and sheath 15, 17.

Mounting holes 13, 13*a* are positioned along hollow beam 15 to be at or very near to the center of gravity of the mobile element 10. When necessary, weights 50 can be added to the mobile element 10 so that the mounting holes 13, 13*a* are aligned with the center of gravity and the mobile element 10 can be balanced around the holes 13, 13*a*.

In a further alternative, if beam 15 is a conducting metal and electrically connected between cell panel 25 and motivator 30, then only one insulated wire 40 is required to form a circuit. Openings through the beam 15 must be insulated properly to avoid shorting the circuit, and contact with other conductors should be avoided. The beam 15 is preferably formed by a square aluminum tube to assist mounting of the substrate 20 and motivator 30, such as described further below.

Figure 6A:
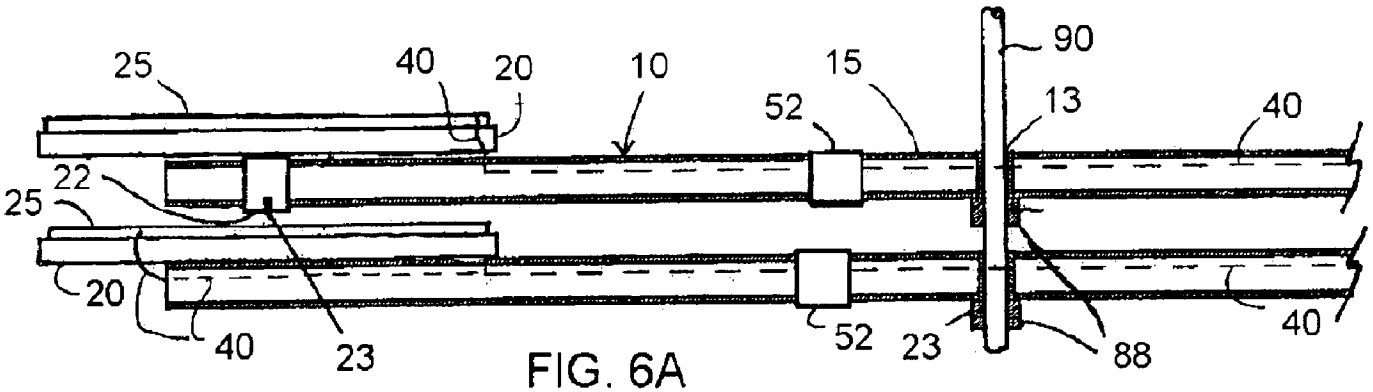
FIG. 6A is a partial sectional side elevation view of an alternate mounting configuration for the power generation end of the mobile element of FIG. 1.
Figure 6B:
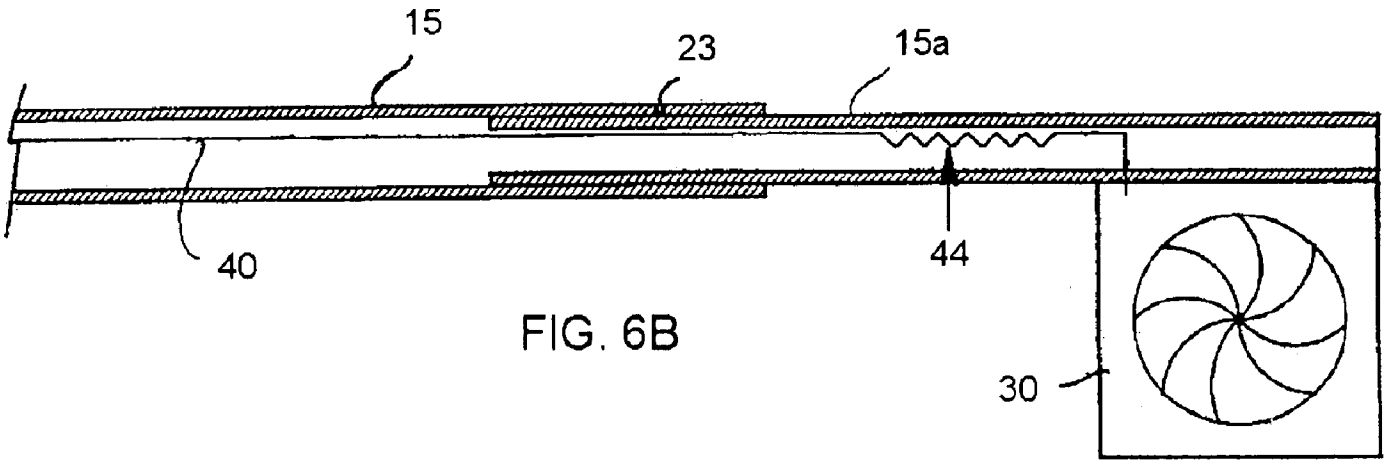
FIG. 6B is a partial sectional side elevation view of the motivator end of the mobile element of FIG. 6A.

FIGS. 6A and 6B display a preferred construction of the mobile element 10 in which the substrate 20 and motivator 30 can be adjustably positioned relative to the support mounting hole 13. FIG. 6A shows the substrate 20 having a connecting slider 22 in the form of a hollow tube having a shape generally corresponding to that of the hollow beam 15. The substrate 20 and connecting slider 22 may be connected as described above when the substrate 20 is secured directly to the hollow beam 15. The connecting slider 22 is then mounted over the hollow beam 15 for longitudinal sliding movement along the beam 15. A set screw 23 is advantageously provided in an exposed side of the connecting slider 22 for tightening to lock the connecting slider 22 and substrate 20 in a specific position. When the beam 15 and slider 22 are polygonal, such as square, they are more easily oriented. The conducting wire 40 may pass through an opening in the hollow beam 15 and is adjustably lengthened or shortened as needed for the selected position of the substrate 20 as further described below.

The hollow beam 15 may also carry a sliding weight 52, which is movable along the length of the hollow beam 15. Movement of the sliding weight 52 will be restricted once a support post 90 is inserted through mounting hole 13.

When the mobile element 10 is joined as part of a mobile by mounting on such a post 90 or other support, fixed bearings 88 can be used to support the mobile element 10 in a specific vertical position on a support post 90. The fixed bearings 88 are initially slidable along the support post 90 and held in place by a set screw 23 or another mechanism which creates a strong friction between the bearings 88 and post 90, such as adhesives.

Referring to FIG. 6B, a hollow beam 15 of the mobile element 10 has a sliding adjustable end section 15*a* on which the motivator is mounted. The end section 15*a* can be adjusted longitudinally by sliding in or out of the hollow beam 15. A set screw 23 is provided for locking the relative position of the beam 15 and end section 15*a*.

The conducting wire 40 has at least one expansion crimp 44 along its length inside the hollow beam 15 and end section 15*a*. When the end section 15*a* is extended from the hollow beam 15, or when the substrate 20 is slid further toward the opposite end of the hollow beam 15, the crimp 44 expands to provide additional length to the conducting wire 40. The expansion crimp 44 thus permits the electrically connected solar panel 25 and motivator 30 to move apart relative to each other while remaining in electrical contact.

The sliding movement made possible by the connecting slider 22 and slidable end section 15*a* permits adjustment of the center of gravity balance point on the beam 15. And, the changeable length further permits different ones of the same basic mobile element 10 to be configured to different lengths to provide a different appearance when they are used in a mobile. The sliding weight 52 permits fine adjustment of the center of gravity for a mobile element 10 set to a specific length. Weights 50 may be used as well to further adjust the center of gravity.

The mobile element 10, in any of the embodiments described above, is preferably combined with several additional elements 10 to make a mobile. Different combinations of the mobile elements 10 are envisioned and the following describes some possible mobiles in greater detail.

Figure 7:
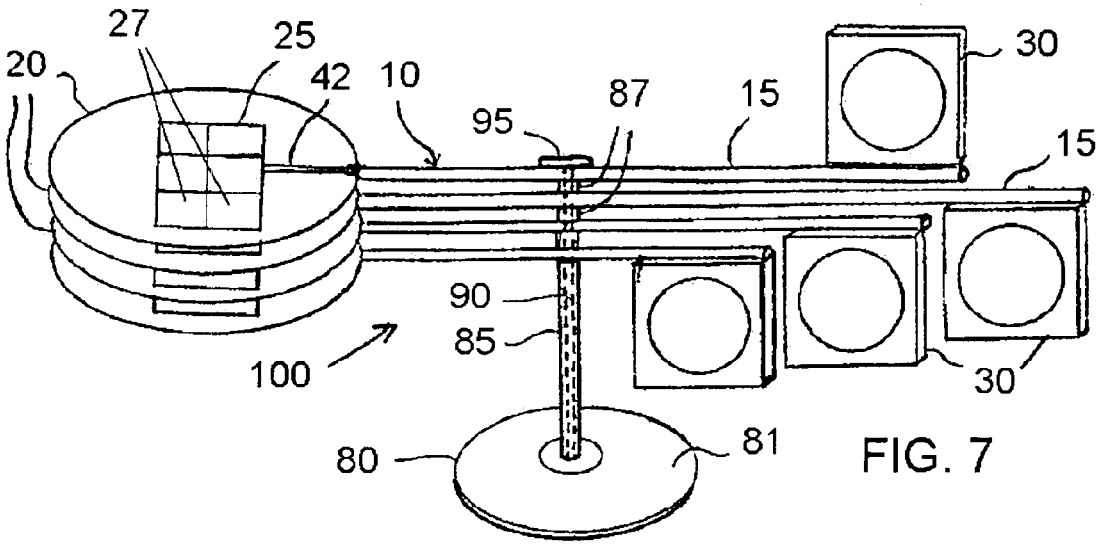
FIG. 7 is a top, side perspective view of a table-top mobile according to the invention.

In FIG. 7, a mobile 100 has four mobile elements 10 arranged with their substrates 20 aligned in a vertical column. The mobile elements 10 are supported above a horizontal surface on stand 80 with support post 90. Post 90 extends through mounting hole 13 in the hollow beam 15 of each mobile element 10 between base 81 and a cap 95. Cap 95 is removably secured to the post 90. A cover 85 and spacers 87 enclose post 90 where it is exposed outside the beams 15.

The cover 85 and spacers 87 each have a diameter greater than that of the mounting holes 13 in the hollow beams 15. As shown in greater detail in FIG. 8, the ends of the cover 85 and spacers 87 contact the beams 15 and support the beams 15 for rotational movement about the post 90. Preferably, the cover 85 and spacers 87 provide a low friction or frictionless connection with the beams 15, so that a large motivating force is not needed to overcome frictional forces and let the hollow beams 15 rotate. The cover 85 and spacers 87 may rotate with the beams 15 as well, or they may be fixed on the post 90. The cover 85 and spacers 87 should be locked in position vertically relative to the adjacent beams 15, however, so that the weight of the beams 15 above is not transferred through the spacers 87 or cover 85 to the lower beams 15, thereby increasing friction and preventing relatively friction-free rotation.

Referring again to FIG. 7, it should be appreciated that the distance from the support post 90 to the nearest edge of each motivator 30 must be greater than the distance from the support post 90 to the farthest edge of each substrate 20 that the relevant motivators 30 have a portion lying in the same horizontal plane, so as to avoid collisions between the motivators 30 and substrates 20. By ensuring the lengths of the hollow beams 15 are sufficient to avoid collisions between mobile elements 10, the solar powered nature of the mobile 100 permits free movement as long as a light source is present.

Some of the motivators 30 of the mobile elements 10 may be arranged to direct a motivating force in the opposing direction to others of the motivators 30. When this is done, some of the mobile elements 10 will rotate clockwise and others of the mobile elements 10 will rotate counterclockwise. When the cap 95 is removable, the arrangement of mobile elements 10 can be changed to further vary the resulting movement, such as by adding elements 10 or removing them, and changing the direction of rotation of an element 10.

Further, if the mobile 100 is originally positioned with the substrates aligned in a tightly spaced vertical column, the mobile elements 10 will not all begin to move at once when exposed to light. The top-most solar cell panel 25 will generate power first, causing the connected motivator 30 to begin producing a motivating force and rotating the mobile element 10, followed by the solar cell panel 25 of the next mobile element 10 in the stack, and so on. And, as the substrates of upper mobile elements 10 pass over the solar cell panels 25 of the lower mobile elements 10, the light will be temporarily blocked, stopping power generation for a short time. The interruption of power will cause the mobile elements 10 to rotate in changing patterns as they interact with each other as long as a light source is present.

Figure 9:
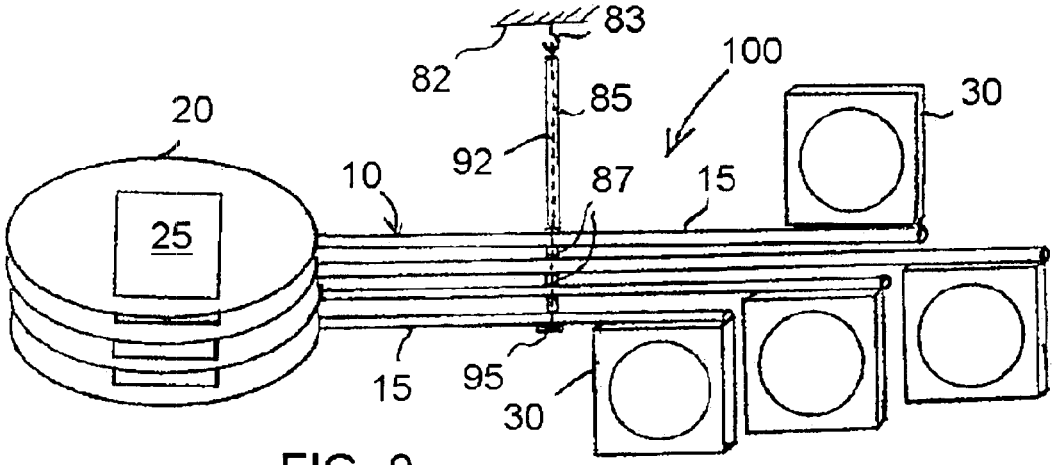
FIG. 9 is a top, side perspective view of a hanging mobile according to the invention.

FIGS. 9 and 10 show a second embodiment of the mobile 100 in which the mobile 100 is suspended from a ceiling 82 or other elevated surface. A strand 92 inserted through the mounting holes 13 of the mobile elements 10 supports the mobile 100 from a hook 83 secured to the ceiling 82. Cap 95 is securely connected to the bottom end of the strand 92. A cover 85 and spacers 87 are provided over the strand 92.

The cover 85 does not perform any support function in this version of the mobile 100, and is only to protect the strand 92. Spacers 87 are the same as for the mobile 100 of FIG. 7. In the mobile 100 of FIG. 9, the cap 95 supports the lower-most mobile element 10, and preferably provides a relatively frictionless interface with the beam 15.

Strand 92 may be a metal wire, such as piano wire, fishing line, string, yarn or other similar material which can support the weight of the mobile 100 without breaking. Since cover 85 is not needed for support, the use of fishing line or another clear material to support the mobile 100 without the cover 85 can produce the illusion that it is hanging freely in space.

It should be noted that while a strand 92 is preferred for use with the mobile 100 of FIG. 9, a post 90 such as used with the embodiment of FIG. 6 may be used in place of strand 92.

In a third embodiment, shown in FIG. 11, the mobile 105 has a structure similar to a conventional Calder type mobile. The mobile 105 is suspended from hook 83 or another fastener in ceiling 82. String 115 supports main beam 110 at a point which is determined to be the center of gravity of the main beam 110 when the mobile 105 is assembled. Each end of the main beam 110 has depending groups of mobile elements 10 balanced against each other. The mobile elements 10 are connected to the main beam 110 directly or by depending from a superior positioned mobile element 10. The mobile 105 can include other decorative objects 130, balanced on the hollow beams 15 with the mobile elements 10.

The various mobile elements 10 of mobile 105 will rotate about in changing patterns as the motivators 30 of each mobile element 10 receive power or are interrupted due to shadowing of the connected solar cell panel 25 from adjacent components. As with the other two embodiments of the mobile 100, the mobile elements 10 may be arranged so that the motivators 30 provide their motivating forces in opposing directions.

The mobiles 100, 105 of the invention provide an advantage over known mobiles in that they are self-powered, and will always have some movement in the presence of a light source. Each mobile element 10 contains its own power source and provides its own motivating force. The inclusion of a solar power cell 27 and a connected motivator 30 on each mobile element 10 overcomes the difficulty of providing power to each motivator 30. And, at the same time, the invention allows each mobile element 10 to have forced, or driven, movement without simply having to connect all of the elements of the mobile to a single, central drive axle.

The mobile elements 10 are provided in at least one embodiment in which they present a use for difficult to recycle materials, such as defective CD-ROMS, computer CPU fans and even the wires from discarded computers. The mobiles 100, 105 of the invention provide a decorative and amusing effect, and will have movement in any sufficiently lighted room or space where sunlight can strike the solar panels 25, even if there is no outside air current.

While a specific embodiment of the invention has been shown and described in detail to illustrate the application of the principles of the invention, it will be understood that the invention may be embodied otherwise without departing from such principles.

What is claimed is:

1. A mobile element for inclusion in a mobile having a plurality of mobile elements connected together and arranged balanced about a mobile center of gravity, the mobile element comprising:

a beam having first and second ends;

a solar cell panel for generating electrical power in the presence of a light source, the solar cell panel connected with the first end of the beam; and a motivator electrically connected to the solar cell panel for receiving the generated electrical power attached to the second end of the beam, so that a motivating force produced by the motivator is directed in major part perpendicular to a longitudinal axis of the beam, wherein an element center of gravity is located on the beam between the solar cell panel and the motivator, and wherein said mobile element is adapted to be supported at or near said element center of gravity within said mobile.

2. A mobile element according to claim 1, further comprising a planar substrate supporting the solar cell panel and connecting the solar cell panel to the first end of the beam.

3. A mobile element according to claim 2, wherein the motivator comprises an electric fan.

4. A mobile element according to claim 3, further comprising a pair of electrical conducting wires extending through a passage formed in the beam between the first and second ends, the pair of wires for electrically connecting the electric fan to the solar cell panel.

5. A mobile element according to claim 4, wherein the beam includes a mounting hole through the beam located at about the element center of gravity.

6. A mobile element according to claim 5, further comprising a sheath extending through the passage, the sheath preventing the pair of wires from obstructing the mounting hole.

7. A mobile element according to claim 3, further comprising a sheath extending through the passage.

8. A mobile element according to claim 3, wherein the substrate is shaped one of square, circular, and triangular.

9. A mobile element according to claim 2, wherein the substrate is one of a CD-ROM disc, a lightweight plastic sheet, and printed circuit board.

10. A mobile element according to claim 1, wherein the motivator comprises an electric fan.

11. A mobile element according to claim 1, wherein at least one of the solar cell panel and the motivator are longitudinally adjustable relative to the other.

12. A mobile element according to claim 1, further comprising a sliding weight mounted on the beam.

13. A mobile providing entertainment and amusement and exhibiting movement in the presence of a light source, the mobile comprising:

a pair of mobile elements, each mobile element comprising a beam having first and second ends, a solar cell panel for generating electrical power in the presence of a light source, the solar cell panel connected with the first end of the beam, a motivator electrically connected to the solar cell panel for receiving the generated electrical power attached to the second end of the beam, so that a motivating force produced by the motivator is directed in major part perpendicular to a longitudinal axis of the beam, wherein an element center of gravity is located on the beam between the solar cell panel and the motivator; and means for supporting each mobile element in spaced vertical relation to the other mobile element for rotational movement about the element center of gravity when the motivating force of the corresponding mobile element is applied.

14. A mobile according to claim 13, wherein the motivator comprises an electric fan.

15. A mobile according to claim 13, wherein each mobile element further comprises a substrate supporting the solar cell panel and connecting the solar cell panel to the beam.

16. A mobile according to claim 15, wherein the substrate comprises one of a CD-ROM disc, a lightweight plastic sheet, and printed circuit board.

17. A mobile according to claim 13, wherein at least one of the solar cell panel and the motivator of each mobile element are longitudinally adjustable relative to the other one of the solar cell panel and motivator.

18. A mobile according to claim 13, further comprising a slidable weight mounted on the beam of at least one of the mobile elements.

19. A mobile providing entertainment and amusement and exhibiting movement in the presence of a light source, the mobile comprising:

a main beam having two ends and a main center of gravity;

a mobile element connected to one of the ends of the main beam, the mobile element comprising an element beam having first and second ends, a solar cell panel for generating electrical power in the presence of a light source, the solar cell panel connected with the first end of the element beam, a motivator electrically connected to the solar cell panel for receiving the generated electrical power attached to the second end of the element beam, so that a motivating force produced by the motivator is directed in major part perpendicular to a longitudinal axis of the element beam, wherein an element center of gravity is located on the element beam between the solar cell panel and the motivator, each at least one mobile element being connected with the main beam from the element center of gravity;

at least one mobile object connected to the other end of the main beam for balancing the main beam so that the main center of gravity is located between the ends of the main beam.

20. A mobile according to claim 19, wherein the at least one mobile object is selected from the group consisting of a second mobile element and a decorative object.

21. A mobile according to claim 19, wherein the motivator is an electric fan.

22. A mobile according to claim 19, wherein the mobile element further comprises a substrate supporting the solar cell panel and connecting the solar cell panel to the beam.

23. A mobile according to claim 19, further comprising means for hanging the main beam to depend from an elevated horizontal surface connected to the main center of gravity.

24. A mobile according to claim 19, wherein at least one of the solar cell panel and the motivator are longitudinally adjustable relative to the other one of the solar cell panel and motivator.

25. A mobile according to claim 19, further comprising a slidable weight mounted on the element beam.

* * * * *